United States Patent [19]

Parraud et al.

[11] Patent Number: 4,833,438

[45] Date of Patent: May 23, 1989

[54] METHOD OF MANUFACTURING A LIGHTNING ARRESTER, AND A LIGHTNING ARRESTER OBTAINED BY THE METHOD

[75] Inventors: René Parraud, Chateldon; Denis Thuillier, Vichy, both of France

[73] Assignee: Ceraver, Courbevoie, France

[21] Appl. No.: 131,797

[22] Filed: Dec. 11, 1987

[30] Foreign Application Priority Data

Dec. 12, 1986 [FR] France ..... 86 17424

[51] Int. Cl.[4] ..... H01C 7/12

[52] U.S. Cl. ..... 338/21; 338/257; 338/275; 29/613; 29/621; 164/102; 264/272.18

[58] Field of Search ..... 29/610 R, 613, 619, 29/621; 338/21, 20, 230, 257, 275, 269; 264/272.18; 164/98, 100, 101, 102; 174/2, 140 C

[56] References Cited

U.S. PATENT DOCUMENTS 2,885,523 5/1959 Wright et al. ..... 338/257
3,394,455 7/1968 Grimmer ..... 264/272.18

FOREIGN PATENT DOCUMENTS 0079569 5/1983 European Pat. Off. .
0196370 10/1986 European Pat. Off. .
0217021 4/1987 .
3002014 7/1981 Fed. Rep. of Germany .
764693 1/1957 United Kingdom ..... 338/21
2073965 10/1981 United Kingdom .

*Primary Examiner*—P. W. Echols
*Attorney, Agent, or Firm*—Sughrue, Mion, Zinn, Macpeak & Seas

[57] ABSTRACT

A double molded over method of manufacturing a lightning arrester in which a central core 1 is made of zinc oxide in a first step, then two metal end fittings 5, 6 are molded onto the end faces and over the side thereof, and finally a coating of elastomer material 7 is molded around the side wall of the central core and over side portions of the end fittings. The core may be formed of a plurality of smaller section bars of zinc oxide regularly disposed about a longitudinal axis with the end fittings molded onto the end faces and about the sides of the end bars whose end faces are partially metallized. In a further variant, a stack of zinc oxide based pellets having the same cross-sectional area as the core in the first example, with the stack having the same overall length as the core if stiffened by thermal compression with fusible metal inserted between pairs of pellets. The stack assembly is then compressed mechanically in conjunction with heat treatment to effect very good mechanical bonding. The core assembly formed thereby is treated as above.

12 Claims, 4 Drawing Sheets

METHOD OF MANUFACTURING A LIGHTNING ARRESTER, AND A LIGHTNING ARRESTER OBTAINED BY THE METHOD

The present invention relates to a method of manufacturing a lightning arrester.

BACKGROUND OF THE INVENTION

A lightning arrester is a device which is placed between a phase and ground in a high tension line, and which serves to limit the amplitude and the duration of atmospheric over-voltages (surges due to lightning and to induction phenomena in the conductors), or to temporary electric overvoltages on the grid (operating surges).

The functions of a lightning arrester are firstly to withstand normal operating tension or a permanent basis, and secondly to pass the high discharge current which appears during a temporary surge, thereby protecting line apparatuses (transformers, . . . ).

These functions are generally provided by a core made of a material of the varistor type and based, for example, on zinc oxide ZnO whose electrical resistivity is highly nonlinear as a function of applied voltage.

This nonlinear characteristic enables such a lightning arrester to pass:

a low current (e.g. about 0.5 mA/cm$^2$) when the operating voltage is applied on a permanent basis to the lightning arrester which then presents a very high resistance, this current is essentially capacitive in origin since the relative permitivity of such varistors is very high; or a high current which may be as high as several tens of kiloamps, when the applied voltage reaches a trigger threshold above which the resistance of the varistor becomes very low.

European patent application EP-A-0.196.370 describes a lightning arrester structure comprising a central core made of a varistor type material, two end fittings which are threaded and glued onto the ends of the side wall of said core, and two intermediate spring blades between the bases of said core and the end fittings; an insulating covering having fins is provided around the side wall of the assembly. Such a structure suffers from drawbacks since firstly it requires the ends of the core to be machined, which machining is likely to damage the ends by creating cracks or breaks, and secondly it requires the end fittings to be glued which may disturb their electrical contact with the ends of the core.

British patent application GB-A-2.073.965 also described a lightning arrester in which the central core comprises a plurality of stacked cylindrical pellets of varistor type material, with two end fittings coming into contact with the pellets by means of spring blades; this assembly is held together mechanically by a one-piece sheath of heat-shrink material. This method is difficult to implement and is therefore expensive.

Preferred implementations of the present invention simplify the manufacture of lightning arresters and reduce the cost thereof.

SUMMARY OF THE INVENTION

The present invention provides a method of manufacturing a lightning arrester comprising a central core which is of generally circular symmetry and which includes at least one varistor, two metal end fittings, and an outer coating of electrically insulating material, wherein metal end fittings are molded onto the at least partially metallized faces of said central core and molded over the side thereof, at said ends, and wherein said outer coating is then molded into place over said core and at least a side portion of said end fittings, said coating being made of a composite material.

The term "composite materials" covers elastomers, EPDM, silicones, . . . , and resins which may optionally be filled (epoxy resin, . . . ).

The metal of said end fittings is such that its melting temperature is about 400° C.; for example, it may be zinc, lead, tin, aluminum, and alloys thereof, such as Zamak.

If the central core is made in one piece, the end fittings are molded directly onto its ends.

If the core is built up from a pluralty of equal-length parallel-connected bars having generally circular symmetry, then the molding into place of the end fittings serves to constitute a unitary assembly, and molding the coating thereover fills the voids between the bars.

If the central core comprises a plurality of superposed pellets, it can be prior-stiffened by means independent of the end fittings, which is a considerable simplification over prior methods.

The stack may be stiffened, for example, by thermo-compression by inserting a thickness of metal between two faces in contact and applying high pressure at high temperature. This operation may also be done in a simple manner by casting or injecting metal between the facing faces of the pellets disposed in a mold.

BRIEF DESCRIPTION OF THE DRAWINGS

Implementations of the invention are described by way of example with reference to the accompanying drawings, in which.

MORE DETAILED DESCRIPTION

Figure 1:
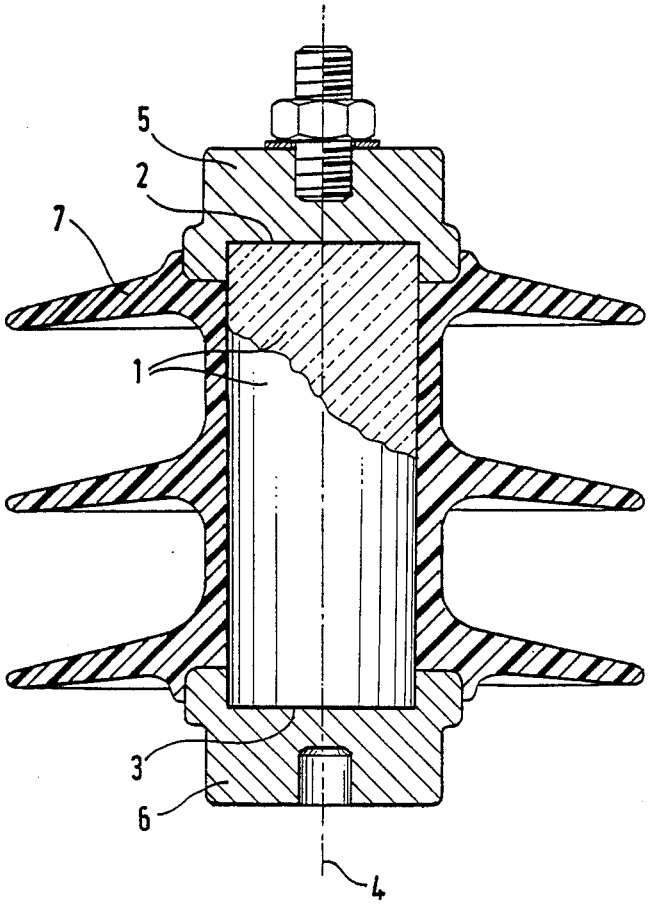
FIG. 1 is a diagrammatic longitudinal section through a lightning arrester in accordance with the invention and having a single varistor.

FIG. 1 shows a core 1 made of a varistor type material, for example a material based on zinc oxide. This core may be generally cylindrical in shape about an axis 4 having two end faces 2 and 3 each provided with a layer of metallization. There is no need for this shape to be regular, nor is there any need for the faces 2 and 3 to be perfectly plane and orthogonal to the axis 4. The metal end fittings 5 and 6 are made by being molded onto the faces of the core 1, and molded over the side thereof, at said ends thereby obtaining good electrical contact between the ends of the core 1 and the end fittings. The end fittings may be made of a material selected from zinc and alloys thereof, aluminum and alloys thereof, etc.

Thereafter, a coating including fins 7, e.g. made of an elastomer such as EPDM, is molded thereover to cover the entire side face of the core 1 together with a side portion of each of the end fittings 5 and 6.

By way of example, the total length of that core is about 180 millimeters (mm) which would be compatible with a nominal operating voltage of 20 kvolts, and it could have a cross-sectional area of about 900 $mm^2$ in order to pass a current surge of more than 40 kAmps for four tenths of a microsecond.

Figure 2A:
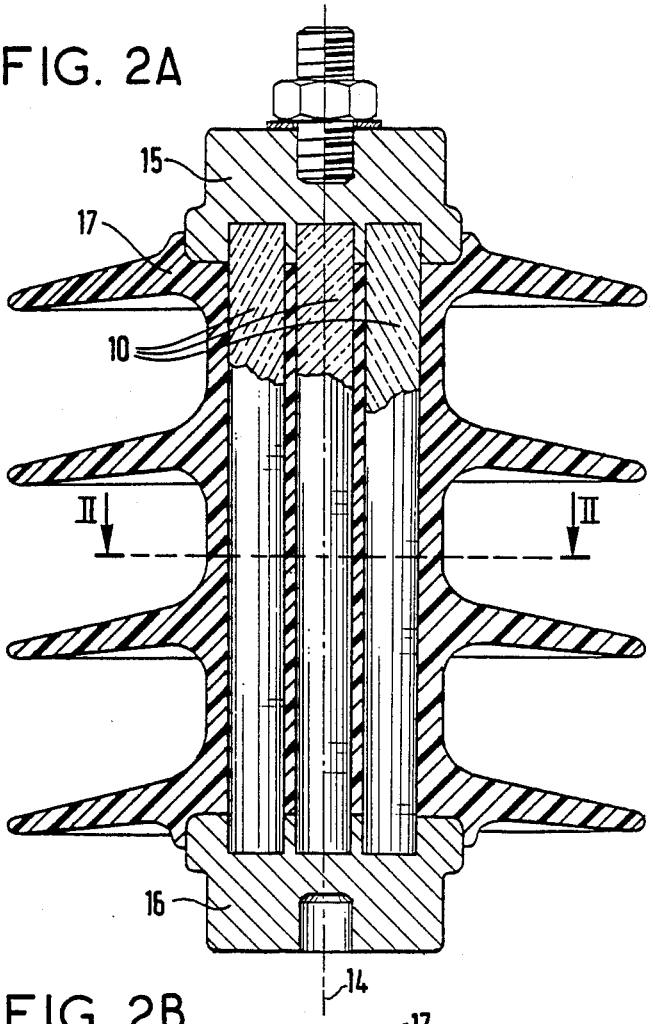
FIG. 2A is a diagrammatical longitudinal section through a lightning arrester in accordance with the invention and having a plurality of juxtaposed varistors.
Figure 2B:
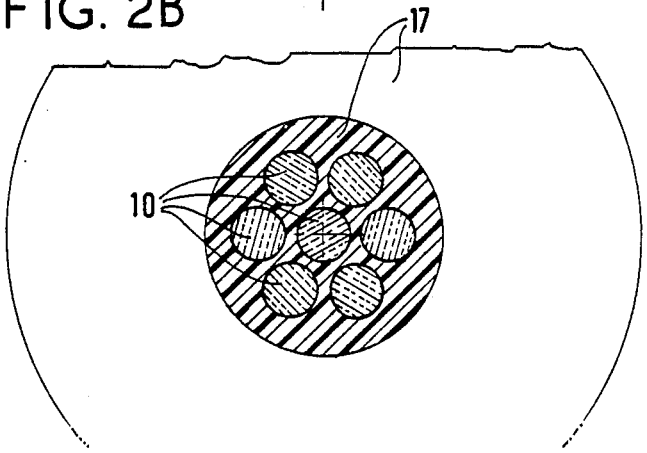
FIG. 2B is a cross-section on line II—II of FIG. 2A.

The core 1 in FIG. 1 may be constituted by a plurality of smaller section bars as shown in FIGS. 2A and 2B which show seven bars 10 based on zinc oxide and regularly disposed about an axis 14. The cross-sectional area of the entire set of bars is equivalent to the area mentioned above for a one-piece bar. The lengths of the bars may be substantially the same for the embodiments shown in FIGS. 1 and 2A.

The end fittings 15 and 16 are molded onto the ends of the bars 10 which are at least partially metallized, and thereafter an elastomer coating 17 is provided, likewise by being molded over the other parts, said elastomer material filling the gaps between the bars 10.

Figure 3:
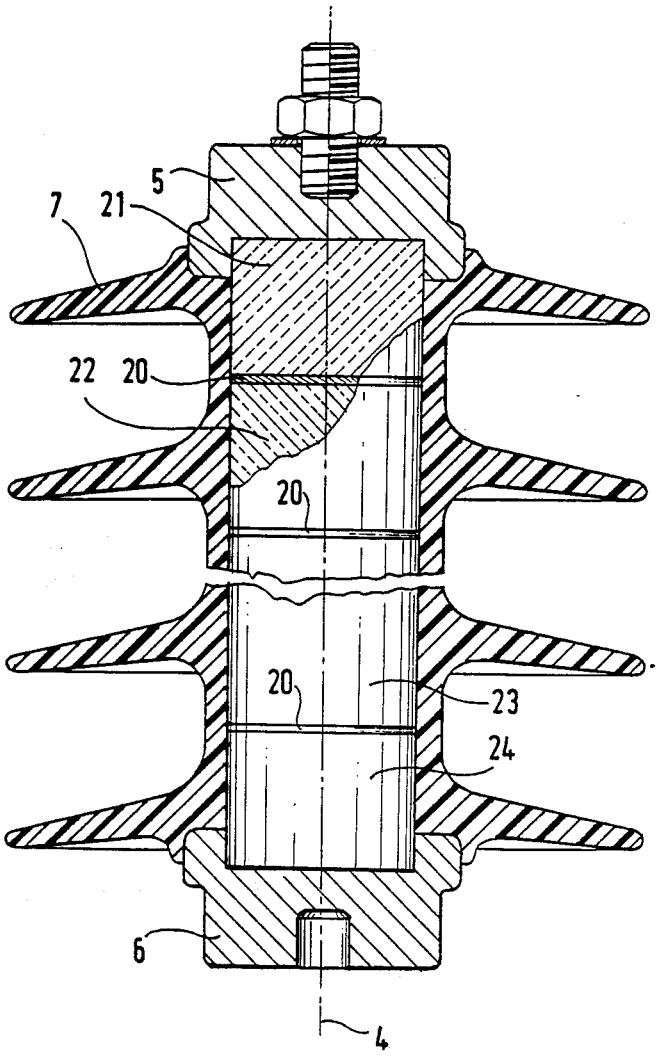
FIGS. 3 and 4 are diagrammatical longitudinal sections through two variant lightning arresters in accordance with the invention and including a plurality of superposed varistors.

FIG. 3 shows a lightning arrester having elements which are identical to those shown in FIG. 1, except that the central core is different. The central core in this variant is constituted by a plurality of zinc oxide based pellets 21, 22, 23, and 24, said pellets having the same cross-sectional area as the core 1, for example, and the stack of pellets having the same overall length as the core 1. This stack is stiffened by binding the contacting faces by thermocompression. To do this, very thin wafers 20 of fusible metal are inserted between pairs of pellets. The assembly is then compressed mechanically in conjunction with heat treatment thereby obtaining very good mechanical bonding.

By way of example, the metal may be a relatively low melting point metal such as zinc. The pressure may be about 1 $kg/mm^2$, and the temperature may be about 400° C.. Once the central core has been made, the assembly method continues in the same way as for the core 1 shown in FIG. 1.

Figure 4:
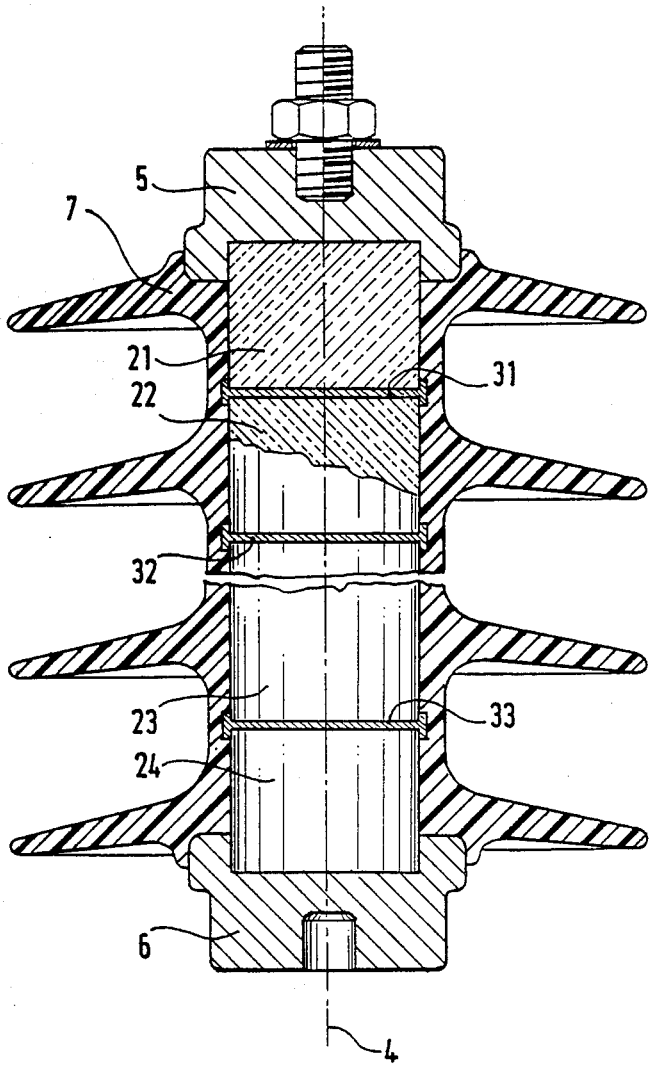

FIG. 4 shows a variant form of bonding between the pellets 21, 22, 23, and 24 in order to consitute the central core. The pellets are placed in a mold leaving small gaps between pairs of facing faces, and a low melting point metal is cast or injected therebetween. The metal may be zinc, Zamak, or lead, thereby creating metal bonds 31, 32, and 33. This operation provides both electrical contact and mechanical fixing between the pellets.

The above-described variants are easily implemented. However, other means could be used for stiffening a stack of pellets in order to obtain a component onto which end fittings and a coating could be molded.

We claim:

1. In a method of manufacturing a lightning arrester comprising applying a central core which is of generally circular symmetry and which includes at least one varistor, two metal end fittings to opposite ends of said core, and applying an outer coating of electrically insulating material about said core, the improvement wherein end faces of the central core are at least partially metallized, said metal end fittings are molded onto the at least partially metallized end faces of said central core, and over the side of said core, at said ends, and wherein said outer coating made of a composite material is then molded into place over said core and over a side portion of said end fittings thereby simplifying the manufacture of the lightning arrester and reducing the cost thereof, with a double molded end fitting and outer coating about said core.

2. A method of manufacturing a lightning arrester according to claim 1, wherein the core is constituted by a plurality of bars each of which is of circular symmetry about an axis, with said bars being mounted in parallel.

3. A method of manufacturing a lightning arrester according to claim 1, wherein said core is constituted by a stack of a plurality of pellets which are axially fixed together prior to said molding operations.

4. A method of manufacture according to claim 3, wherein said superposed pellets are fixed together by thermocompression.

5. A method of manufacture according to claim 3, wherein said superposed pellets are fixed together by casting or injecting a low melting point metal between the pellets which are disposed in a mold.

6. A method of manufacture according to claim 1, wherein said composite material is one selected from: the group consisting of elastomers, EPDM, silicones, and resins.

7. A method according to claim 1, wherein said varistor comprises zinc oxide.

8. A method according to claim 1, wherein the material of said end fittings is one selected from low melting point metals consisting of: lead, aluminum, tin, zinc, and alloys thereof.

9. A double molded lightning arrester comprising a central core of generally circular symmetry including at least one varistor, said central core including end faces being, at least partially metallized, two molded metal end fittings molded respectively onto said at least partially metallized end faces of said central core and over the side of said core at said ends, and a molded outer coating about said core and at least a side portion of said molded metal end fittings thereby simplifying the manufacture of the lightning arrester and reducing the cost thereof.

10. The lightning arrester as claimed in claim 9, wherein said core is constituted by a plurality of bars each of which is of circular symmetry about an axis and said bars being mounted in parallel.

11. The lightning arrester as claimed in claim 9, wherein said core comprises a stack of a plurality of pellets thermocompression fixed together.

12. The lightning arrester as claimed in claim 11, further comprising a low melting point metal interposed between the stack of pellets.

* * * * *